US006188395B1

(12) United States Patent
Yatabe

(10) Patent No.: US 6,188,395 B1
(45) **Date of Patent: *Feb. 13, 2001**

(54) POWER SOURCE CIRCUIT, POWER SOURCE FOR DRIVING A LIQUID CRYSTAL DISPLAY, AND A LIQUID CRYSTAL DISPLAY DEVICE

(75) Inventor: Satoshi Yatabe, Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/702,626

(22) PCT Filed: Jan. 10, 1996

(86) PCT No.: PCT/JP96/00023

§ 371 Date: Aug. 30, 1996

§ 102(e) Date: Aug. 30, 1996

(87) PCT Pub. No.: WO96/21879

PCT Pub. Date: Jul. 18, 1996

(30) Foreign Application Priority Data

Jan. 13, 1995 (JP) ..... 7-004480

(51) Int. Cl.[7] ..... G09G 5/00

(52) U.S. Cl. ..... 345/211; 345/212; 345/210; 345/95; 323/267

(58) Field of Search ..... 345/211, 204, 345/210, 212, 215, 95; 323/267, 280

(56) References Cited

U.S. PATENT DOCUMENTS 4,158,786 * 6/1979 Hirasawa ..... 307/34
4,668,875 * 5/1987 Miyazaki et al. ..... 307/106
5,130,703 * 7/1992 Fairbanks et al. ..... 340/784
5,250,937 * 10/1993 Kikuo et al. ..... 345/89
5,343,221 * 8/1994 Arakawa et al. ..... 345/211
5,646,643 * 7/1997 Hirai et al. ..... 345/100
5,650,801 * 7/1997 Higashi ..... 345/210
5,734,379 * 3/1998 Natsumi et al. ..... 345/211
5,781,001 * 7/1998 Takemoto ..... 323/267

FOREIGN PATENT DOCUMENTS 91 15 126 * 3/1992 (DE) .
2-150819 * 6/1990 (JP) .
3-230116 * 10/1991 (JP) .
3-230117 * 10/1991 (JP) .
3-230188 * 10/1991 (JP) .
4-294325 * 10/1992 (JP) .

OTHER PUBLICATIONS

Electronic Design, vol. 38, No. 24, Dec. 27, 1990, Hasbrouck Heights, New Jersey, US, p. 63 XP000178363 Nagaraj M S: "OP AMP Regulates Its Own Supply".*

* cited by examiner

*Primary Examiner*—Dennis-Doon Chow
*Assistant Examiner*—Amr Awad
(74) *Attorney, Agent, or Firm*—Oliff & Berridge, PLC

(57) ABSTRACT

A power source circuit which is suitable as a power source for use in driving a liquid crystal display, wherein on the basis of the power source electric potentials (VDD, VEE), the voltage is divided by voltage dividing resistors (R1 to R5), and passes through operational amplifiers (OP1 to OP4) that comprise voltage followers, so that output electric potentials (V1 to V5) are output. The power source electric potential (VDD) and the intermediate electric potential (Va) which is output from a voltage dividing circuit (S) are supplied to the operational amplifiers (OP1, OP2), and the intermediate electric potential (Va) and the power source electric potential (VEE) are supplied to the operational amplifiers (OP3, OP4). In the voltage dividing circuit (S), a parallel circuit component comprising a large resistors (R12) and a condenser (C5) and a parallel circuit component comprising a large resistor (R13) and a condenser (C6) are connected in series between the power source electric potential (VDD) and the power source electric potential (VEE), and the intermediate electric potential (Va) is output from the point of connection of these two parallel circuit components.

26 Claims, 12 Drawing Sheets

POWER SOURCE CIRCUIT, POWER SOURCE FOR DRIVING A LIQUID CRYSTAL DISPLAY, AND A LIQUID CRYSTAL DISPLAY DEVICE

BACKGROUND OF THE INVENTION

1. Field of the Invention

The present invention relates to a power source circuit, a power source for driving a liquid crystal display, and a liquid crystal display device, and more particularly, to a new structure for a multiple output power source circuit which can supply a plurality of suitable electric potentials as a power source for driving the liquid crystal panel in a liquid crystal display device.

2. Description of Related Art

Conventionally, power source circuits which supply a plurality of electric potentials have been used for the driving circuit in liquid crystal panels, and one example of these power source circuits is disclosed in Japanese Laid-Open Patent Publication Hei 2-150819. FIG. 11 shows the basic structure of this conventional power source circuit. In the liquid crystal panel 1, a plurality of parallel segment electrodes SE1, SE2, . . . , (hereafter abbreviated as SEn) which extend in stripe form, and a plurality of parallel common electrodes CE1, CE2, . . . (hereafter abbreviated as CEn) which extend in a direction orthogonal to the segment electrodes, are provided in a state facing each other with an unrepresented liquid crystal layer interposed in between. The areas of the liquid crystal layer where these segment electrodes SEn and the common electrodes CEn cross comprise pixels, the optical state of which can change and which can be controlled to be dark or bright, and through the plurality of pixels, a desired display state can be reproduced over the liquid crystal panel as a whole.

When the attempt is made to display a desired picture image on the liquid crystal panel 1, specific electric potentials are impressed for a specific length of time by a liquid crystal driving circuit in order to form the pixel state corresponding to the picture image display on the segment electrodes SEn and the common electrodes CEn, and through so-called time division driving, the state of each pixel is controlled, said pixels having a structure which is equivalent to a condenser with the liquid crystal layer interposed between electrodes.

The circuit shown in FIG. 11 is a multiple output power source circuit which is used to supply the electric potentials V0, V1, V2, V3, V4 and V5 to the driving circuit of the liquid crystal panel 1. In this circuit, first, using the high electric potential VDD, which is the power source electric potential that is supplied from the power source, and the low electric potential VEE as a base, the voltage is divided by voltage dividing resistors R1, R2, R3, R4 and R5, to form intermediate electric potentials V1, V2, V3 and V4. These intermediate electric potentials V1, V2, V3 and V4 are input into the noninverting input terminals of the operational amplifiers OP1, OP2, OP3 and OP4 which are formed inside the integrated circuit 2. These operational amplifiers OP1, OP2, OP3 and OP4 are composed as voltage followers with the output terminals and inverting input terminals short circuited, and can supply the intermediate electric potentials V1, V2, V3 and V4 with low output impedance.

The output side of the operational amplifiers OP1, OP2, OP3 and OP4 are connected to resistors R8, R9, R10 and R11, respectively, and the resistors R8 through R11 restrict the output current of the operational amplifiers OP1 through OP4. In addition, after this, the top three electric potentials, out of the six electric potentials including the power source electric potential VDD and VEE, and the bottom three electric potentials are connected by condensers C1, C2, C3 and C4 between the respective electric potentials.

From the power source circuit thus formed, six output electric potentials V0 to V5 are output, with the power source electric potentials VDD as V0 and VEE as V5. These output electric potentials V0 through V5 are impressed on the respective segment electrodes SEn and common electrodes CEn through the liquid crystal driving circuit which acts in accordance with the field signal corresponding to the picture image.

The voltage levels necessary when the liquid crystal panel is time division driven with high duty by the voltage averaging law are generally as shown in FIG. 12, and are the output electric potentials V0 to V5 having the relationships $$V0-V1=V1-V2=V2-V3=V3-V4=V4-V5 \quad (1)$$

(here, V0>V1>V2>V3>V4>V5).

The signals which are applied to the segment electrodes SEn and the common electrodes CEn are, for example, as shown in FIG. 12. In FIG. 12, the signal electric potential which is impressed on the segment electrodes SEn and is indicated by the dashed lines switches to either V3 or V5 within the interval of frame 0 (hereafter called Fr0) shown in FIG. 12, and in addition, switches to either V0 or V2 in the interval of frame 1 (hereafter called Fr1) shown in FIG. 12. For example, the signal electric potential V0 corresponds to the on state of the corresponding pixel region, and the signal electric potential V2 corresponds to the off state. The switching state between the electric potential levels of the segment electrodes SEn changes depending on the pattern displayed.

On the other hand, the signal electric potential impressed on the common electrodes CEn is normally the non-selective state of V4 in the interval of Fr0, and becomes the selective state of V0 for only a specific interval. In addition, in the interval of Fr1, the electric potential is normally the non-selective state of V1, and becomes the selective state of V5 for only a specific interval. The interval over which the common electrodes CEn achieve the selective state differs for each common electrode, and in general, the plurality of common electrodes CEn do not achieve the selective state simultaneously.

The intervals of Fr0 and Fr1 shown in FIG. 12 alternatingly repeat, and through this the liquid crystal layer in the pixel areas undergoes alternating current driving, thereby preventing deterioration of the liquid crystal layer.

When the electric potential levels of these kinds of segment electrodes SEn and common electrodes CEn switches, the capacitance (composed of the segment electrode, the common electrode and the liquid crystal layer interposed therebetween) of the pixels which exist in plurality in the liquid crystal panel is charged and discharged, and consequently, an electric current is created between each of the electric potential levels of the output electric potentials V0 through V5 of the power source circuit through the liquid crystal panel. At this time, the switching of the electric potential level of the segment electrodes SEn is accomplished between V0 and V2, or between V3 and V5, and in addition, the majority of the common electrodes CEn are in a non-selective state, being the electric potential level of either V1 or V4. Accordingly, the electric current accompanying the switching of the electric potential levels of the segment electrodes SEn primarily flows between V0, V1 and V2, and between V3, V4 and V5. In contrast to this, the common electrodes CEn are, as described above, for the most part in a non-selective state being the electric potential level of either V1 or V4, but this becomes the electric potential level of V0 or V5 when the selective state is achieved. Accordingly, the electric current accompanying switching of the electric potential levels of the common electrodes primarily flows between V0, V3, V4 and V5, and between V0, V1, V2 and V5.

The current which is generated in the power source circuit created when the liquid crystal panel 1 is driven using this type of electric current, that is to say the above-described power source circuit, is supplied as a portion of the electric current which flows from the power source electric potential VDD to VEE. In other words, when considering, for example, the electric current which flows from the electric potential level V3 to V4 in the liquid crystal panel accompanying the switching of the electric potential levels of the segment currents SEn, this electric current flows initially out from the power source electric potential VDD, as shown in FIG. 11, and flows across the operational amplifier OP3 into the liquid crystal panel 1 at the electric potential level V3, returns to the electric potential level V4 from the liquid crystal panel 1 and flows finally to the power source electric potential VEE via the operational amplifier OP4. Accordingly, when the power source circuit shown in FIG. 11 supplies an electric current which flows out from the output electric potential V3 to the liquid crystal panel 1 and returns to V4, the power consumption caused by the electric current that flows from the power source electric potential VDD to the output electric potential V3, and the power consumption caused by the electric current that flows from the output electric potential V4 to the power source electric potential VEE is only that of generating heat in the operational amplifiers OP3 and OP4, and there is no effective work with respect to the liquid crystal panel 1, so that there is no wasted power consumption.

The electric current which is generated accompanying the switching of the electric potential levels of the segment electrodes SEn flows primarily between V0, V1 and V2, and between V3, V4 and V5, while the electric current which is generated accompanying the switching of electric potential levels of the common electrodes CEn flows primarily between V0, V3, V4 and V5, and between V0, V1, V2, and V5, and consequently, the former has a smaller voltage between each electric potential level than the latter. Accordingly, in contrasting the supplying of electric current accompanying the switching of the electric potential levels of the segment electrodes SEn and the supplying of electric current accompanying the switching of the electric potential levels of the common electrodes CEn using the power source circuit of FIG. 11, the division of power which is consumed in the liquid crystal panel 1 is smaller in the former than in the latter with respect to the above-described wasted power consumption, and consequently, more power is wasted.

In recent years, demand for larger capacity and faster liquid crystal display panels has risen, and the shift to high duty in time-division driving of liquid crystal panels for this purpose has been dramatic. In order to increase the duty ratio during driving in this way, a larger voltage is necessary as the power source voltage and the electric potential difference between the high electric potential VDD and the low electric potential VEE expands, and consequently, the following problems are created in the conventional power source circuit shown in FIG. 11.

(1) Because the above-described power source electric potentials VDD and VEE are used as the power source of the operational amplifiers, the power consumption which is caused by the operational amplifier idling current which flows steadily increases because of the expansion of this electric potential difference.

(2) Because of the rise in power source voltage, it is necessary to use expensive, high voltage-resistance operational amplifiers as the operational amplifiers used in the power source circuit.

(3) Because of the rise in power source voltage, the wasted amount of power which is consumed in the above-described power source circuit, in particular the wasted power consumption which is created when the electric current accompanying switching of the electric potential levels of the segment electrodes SEn is supplied, increases.

Thus, in consideration of the foregoing problems, it is an objective of the present invention to compose a power source circuit which has low power consumption and moreover is an inexpensive power source circuit, and in particular is suitable as the power source for driving a liquid crystal display, and through utilizing such a power source circuit, to reduce power consumption in the liquid crystal display device as a whole and to reduce production costs.

SUMMARY OF THE INVENTION

The present invention is a power source circuit, comprising: a plurality of output circuit units which supply a plurality of output electric potentials on the basis of a first electric potential and a second electric potential which differs from this first electric potential; and an intermediate electric potential forming unit which forms one or a plurality of intermediate electric potentials between the first electric potential and the second electric potential; wherein one of the electric potentials out of the first electric potential, the second electric potential and the intermediate electric potential(s), and an intermediate electric potential which differs from this electric potential, are supplied as the driving electric potentials of the output circuit unit. Through this, it is possible for the electric potential difference between the two driving electric potentials which are supplied to the output circuit to be reduced more than the electric potential difference between a first electric potential and a second electric potential, and consequently, it is possible to reduce the voltage resistance of the circuit device of the output circuit, and also to reduce the power consumption via the output circuit. The reduction of voltage resistance in the circuit device causes the production costs of the power source circuit to be reduced.

It is preferable for the first electric potential and the intermediate electric potentials to be supplied as the driving electric potentials to a portion of the output circuit units, out of the plurality of output circuit units, and the intermediate electric potentials and the second electric potential to be supplied as the driving electric potentials to the rest of the output circuit units, out of the output circuit units. In this case, the first electric potential and the second electric potential are used as one of the driving electric potentials, and consequently, the number of intermediate electric potentials can be kept to a minimum.

In addition, it is preferable for an electric potential maintaining means to be provided on the intermediate electric potential forming unit in order to suppress fluctuations in the intermediate electric potentials. There are cases where the electric potential maintaining means has a capacitance which is connected between the intermediate electric potentials and the other electric potentials. By providing an electric potential maintaining means, fluctuations in the intermediate electric potentials can be controlled, and it is also possible to reduce the amplitude of the fluctuations in the driving voltage of the output circuit.

Furthermore, it is preferable for the intermediate electric potential forming unit to be a voltage divider which forms the intermediate electric potentials on the basis of the first electric potential and the second electric potential. This kind of voltage dividing circuit can be composed most easily, and a reliable voltage dividing function can be achieved.

In this voltage dividing circuit, there are cases where voltage divider resistances are provided, or where a zener diode is provided, or where one or a plurality of forward-direction diodes are provided, as at least a portion of the voltage dividing means in the voltage dividing circuit.

In addition, it is preferable for an electric potential fluctuation limiting means to be provided which limits the electric potential fluctuations of the intermediate electric potentials to a specific range. Because it is possible to reduce the amount of fluctuation in the intermediate electric potentials through an electric potential fluctuation restricting means, it is possible to control fluctuations in the driving voltage of the output circuit, and consequently, it is possible to obtain stable output properties.

It is desirable for the electric potential fluctuations limiting means to be a limiter circuit that sets the upper limit electric potential and the lower limit electric potential of the intermediate electric potentials.

It is desirable for the limiter circuit to be provided with a first activity device which sets the upper limit electric potential of the intermediate electric potentials, and a second activity device which sets the lower limit electric potential of the intermediate electric potentials. In this case, it is possible to reduce the power consumption while securing stable output circuit actions because the intermediate electric potentials are controlled in accordance with conditions by the activity device.

Furthermore, there are cases where the output circuit unit is a circuit unit primarily composed of a voltage follower comprised of operational amplifiers into which are input electric potentials which are formed by dividing voltages on the basis of the first electric potential and the second electric potential. In this case, it is possible to reduce the driving voltage of the operational amplifiers even if the electric potential difference between the first electric potential and the second electric potential is large, and consequently, it is possible to use inexpensive operational amplifiers with low voltage resistance, and it is also possible to reduce the amount of power which is consumed in the operational amplifiers.

It is very desirable for each of the above-described power source circuits to be used as a power source for driving a liquid crystal display. By utilizing the power source circuit having the above-described structure, which can output in a stable manner a plurality of output electric potentials, as the power source for driving a liquid crystal display, it is possible to reduce power consumption and reduce production costs.

In addition, it is very preferable to equip a liquid crystal display device with this power source, and in this case also, it is possible to reduce wasted power consumption in the liquid crystal display device as a whole and to reduce production costs.

DETAILED DESCRIPTION OF PREFERRED EMBODIMENTS

Next, the power source circuit of the present invention, in particular a device used in a power source for driving a liquid crystal and an embodiment of the liquid crystal display device using such, will be described with reference to the attached drawings in order to explain the present invention in greater detail. The present invention is not limited to a power source circuit which is used as the power source for driving a liquid crystal display, and can be applied widely as the composition of various power source circuits which have a plurality of output electric potentials, but in the following, cases wherein this invention is utilized in a power source for driving a liquid crystal and in a liquid crystal display device will be described as examples.

Embodiment 1

Figure 1:
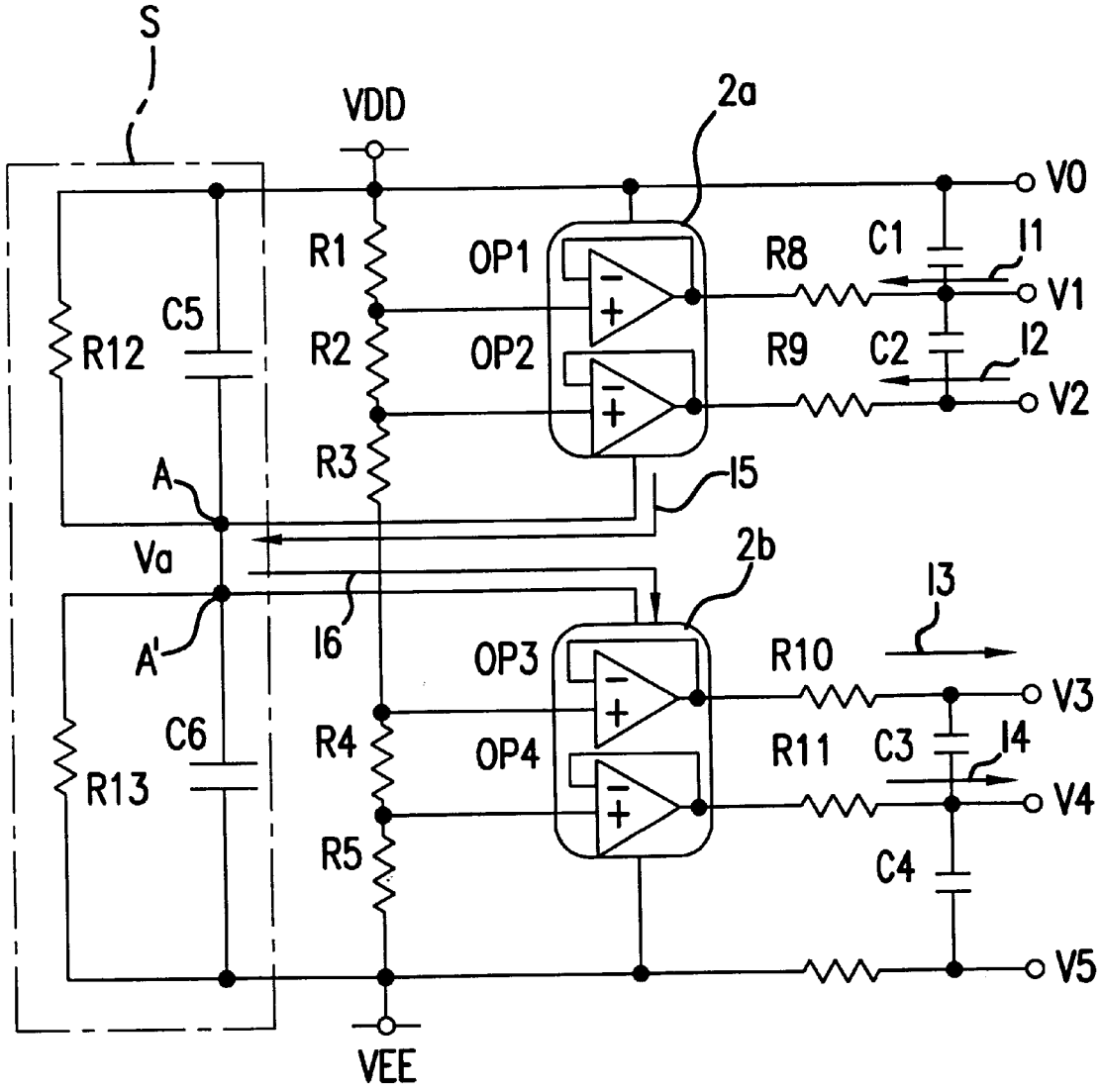
FIG. 1 is a schematic circuit diagram showing the composition of a power source circuit used for driving a liquid crystal display showing preferred embodiments 1 and 2 of the present invention.

FIG. 1 shows the circuit composition of a power source circuit of embodiment 1 for use in driving a liquid crystal display. In FIG. 1, the power source electric potentials VDD and VEE (with VDD>VEE) are supplied from an external power source (not shown), and resistors R1, R2, R3, R4 and R5 are connected in series between these power source electric potentials VDD and VEE to divide the voltage, so that intermediate electric potentials V1, V2, V3 and V4 are created. The output impedance is reduced by supplying these intermediate electric potentials through voltage followers which are comprised of operational amplifiers OP1, OP2, OP3 and OP4.

The outputs of operational amplifiers OP1, OP2, OP3 and OP4 are output via resistors R8, R9, R10 and R11 which are used to limit the output current of the operational amplifiers, and the output electric potentials V1, V2, V3 and V4, along with the power source electric potentials VDD=V0 and VEE=V5, are supplied to the driving circuit of a liquid crystal panel (not shown). Here, smoothing capacitors C1, C2, C3 and C4 are respectively connected between the output electric potentials V0 and V1, V1 and V2, V3 and V4 and V4 and V5.

Between the power source electric potentials VDD and VEE, a voltage dividing circuit S is connected in parallel with the circuit composed of the above-described voltage dividing resistors R1, R2, R3, R4 and R5. In this voltage dividing circuit S, a part wherein a large resistor R12 and a capacitor C5 are connected in parallel, and a part where a large resistor R13 and a capacitor C6 are connected in parallel, are connected in series, and the intermediate electric potential Va is taken from the intermediate points A and A' which are these connecting points.

Because R12=R13 in the present embodiment, this intermediate electric potential Va is set to the value $$Va=(VDD+VEE)/2=Vo \quad (2)$$

under normal conditions.

In a circuit part 2*a* having the above-described operational amplifiers OP1 and OP2, the power source electric potential VDD and the intermediate electric potential Va are supplied as operation electric potentials which cause the operational amplifiers to operate, and in addition, in the circuit part 2*b* having the above-described operational amplifiers OP3 and OP4, the intermediate electric potential Va and the power source electric potential VEE are supplied as operation electric potentials.

In the above-described embodiment, the idling electric currents of the operational amplifiers OP1 through OP4 exist as the steady electric currents which flow through the power source circuit during non-driving times when the liquid crystal panel is not active. In this case, these idling electric currents are substantially balanced because operational amplifiers having the same rating are used as the operational amplifiers OP1 through OP4, so theoretically, the intermediate electric potential Va of the intermediate points A and A' should be stable at the value given by the above equation (2). However, in actuality, there are variances in the properties even in operational amplifiers having the same rating as described above, so that some unbalance in the idling electric currents exists. In addition, there is also an unbalance in the ineffective electric currents that flow outside the liquid crystal layer, for example in the liquid crystal driving circuit. Accordingly, in order to make the intermediate electric potential Va stable during non-driving of the liquid crystal panel, it is necessary to clamp the intermediate electric potential Va by setting the resistance values of the large resistors R12 and R13 high.

On the other hand, when the liquid crystal panel is driven, a non-steady current flows because of the switching of the liquid crystal driving electric potentials impressed on the segment electrodes SEn and the common electrodes CEn. This non-steady current is a portion of the current which flows from the high electric potential VDD to the low electric potential VEE similar to the case of the above-described conventional example. In the present embodiment, the case wherein a charging current flows to the pixels of the liquid crystal panel because of the output electric potentials V1 and V2 and the case wherein a discharging current flows from the liquid crystal panel because of the output electric potentials V3 and V4 are the same as in the conventional example.

However, the points of difference between the present embodiment and the conventional example lie in the fact that a current I5 flows to the intermediate point A via the operational amplifiers OP1 and OP2 when discharging currents I1 or I2 from the pixels of the liquid crystal panel are created which are absorbed by the operational amplifiers OP1 and OP2 via the resistors R8 and R9, and a current I6 flows from the intermediate point A' to the operational amplifiers OP3 and OP4 when charging currents I3 or I4 are created which flow from the operational amplifiers OP3 and OP4 to the pixels of the liquid crystal panel via the resistors R10 and R11.

The creation of this current I5 causes the intermediate electric potential Va to temporarily rise, and the creation of the current I6 causes the intermediate electric potential Va to temporarily drop. Accordingly, in either case the intermediate electric potential Va changes, and through this the operation voltage which causes the operational amplifiers OP1, OP2, OP3 and OP4 to operate fluctuates.

Figure 2:
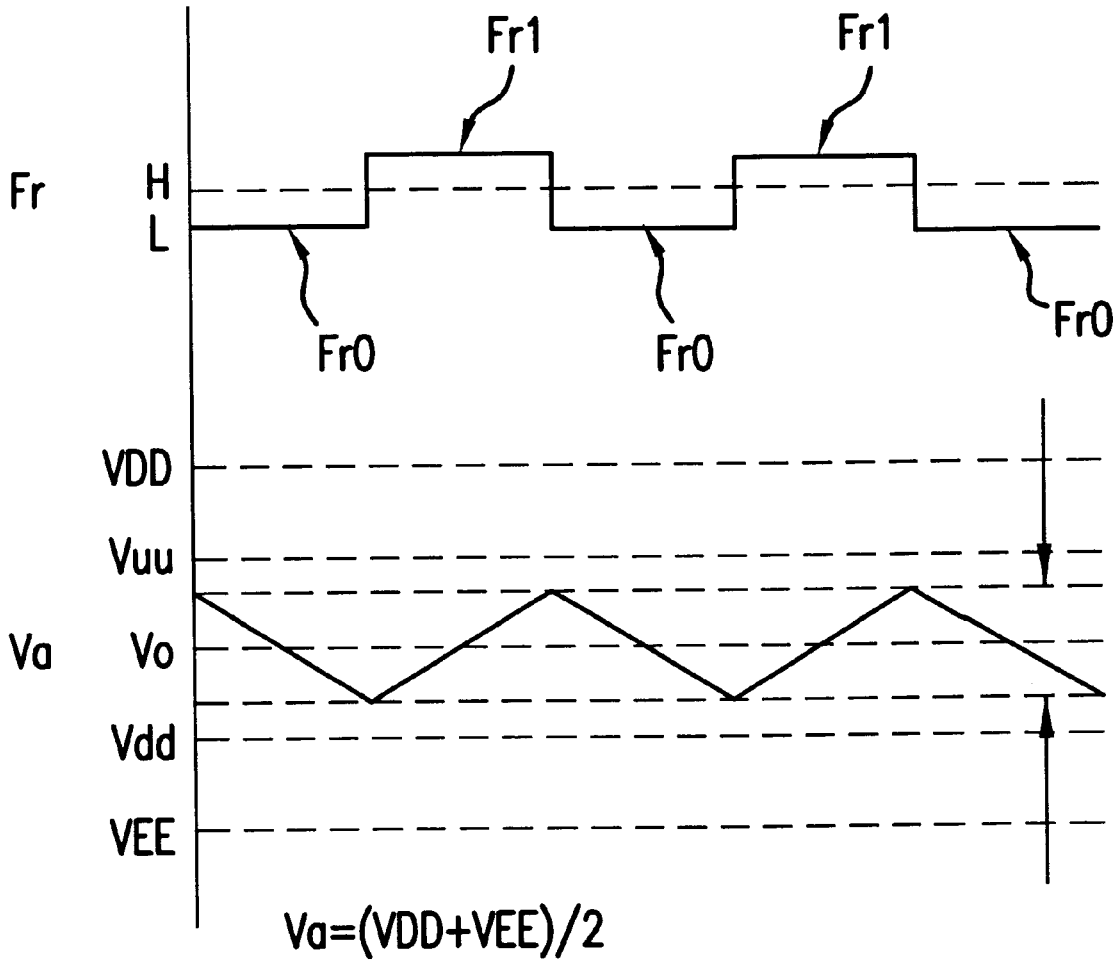
FIG. 2 is a graph showing the relationship between the intermediate electric potential Va and the frame interval when embodiments 1 and 2 are used in driving a liquid crystal display.

FIG. 2 shows the state of fluctuations in the above-described intermediate electric potential Va. In the interval of Fr0, with the segment electrodes SEn in an off state and the common electrodes CEn in a non-selective state, the output electric potential V3 is supplied to the segment electrodes SEn of the liquid crystal panel, and the output electric potential V4 is supplied to the common electrodes CEn. On the other hand, in the interval of Fr1, with the segment electrodes SEn similarly in an off state and the common electrodes CEn in a non-selective state, the output electric potential V2 is supplied to the segment electrodes SEn and the output electric potential V1 is supplied to the common electrodes CEn.

Accordingly, in the interval of Fr0, the intermediate electric potential Va of the intermediate points A and A' drops because of changing currents I3 and I4 to the liquid crystal pixels which flow at the output electric potentials V3 and V4, and in the interval of Fr1, the intermediate electric potential Va rises because of the discharging currents I1 and I2 from the liquid crystal pixels which flow at the output electric potentials V1 and V2. In this case, because of alternating current driving through a driving voltage of reverse polarity in Fr0 and Fr1 in order to prevent deterioration of the liquid crystal, the time integral value (the moving change quantity caused by the current) in the interval of Fr0 which is the discharging current I1+I2 and the time integral value in the interval of Fr1 of the charging current I3+I4 are substantially equivalent from the relationships in above-described equations (1) and (2). Consequently, the intermediate electric potential Va such as is shown in FIG. 2 repeatedly fluctuates with a period in accordance with the frame interval with substantially equivalent rising and falling centered about the value Vo =(VDD+VEE)/2.

In general, operational amplifiers do not produce output fluctuations even if the power source voltage fluctuates to some degree, if this fluctuation is within a prescribed range. This prescribed range depends on the properties of the operational amplifier. Accordingly, by keeping the electric potential fluctuations of the intermediate electric potential Va within this prescribed range, sure operations are possible as a power source circuit.

With the present embodiment, it is possible to cause operation similar to the conventional power source circuit as described above, and it is possible to make the operation voltage of the operational amplifiers half that of the conventional example, and consequently, the effect is achieved that it is possible to use low voltage resistance, inexpensive devices as the operational amplifiers.

The fluctuation amplitude of the intermediate electric potential Va depends on each of the circuit constants in FIG. 1, and in particular, varies widely because of the resistance of the resistors R12 and R13 and the capacitance of the capacitors C5 and C6. In addition, besides these circuit constants, the condition of the liquid crystal display which is being driven has a great influence. That is to say, the fluctuation amplitude of the intermediate electric potential Va depends on the structure of the liquid crystal panel module itself, the driving conditions of the liquid crystal, and the image pattern which is displayed on the liquid crystal panel.

Accordingly, the setting of the up-and-down fluctuation amplitude of the intermediate electric potential Va is accomplished by driving the liquid crystal panel with the worst display pattern (e.g., a pattern which displays a checkerboard on the entire screen, a pattern which displays horizontal stripes, or the like) which can be thought of as that which makes the above-described fluctuation amplitude a maximum, at the point in time when the module structure of the liquid crystal panel and the driving conditions have been determined, and adjusting the resistance of the resistors R12 and R13 and the capacitance of the capacitors C5 and C6 of FIG. 1 so that the fluctuation amplitude of the intermediate electric potential at this time does not deviate from the permissible operation voltage range of the operational amplifiers.

Figure 10:
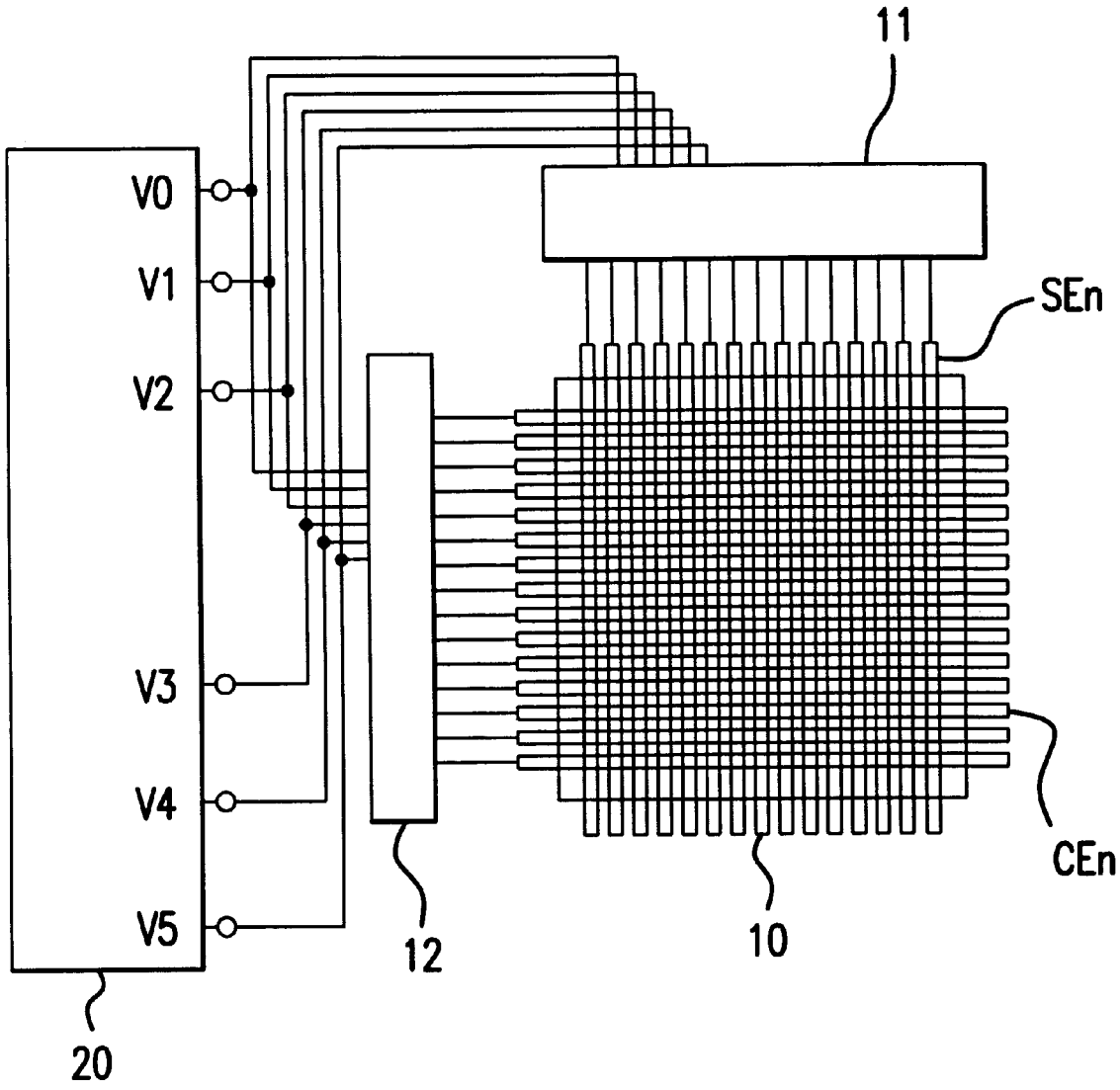
FIG. 10 is a schematic composition diagram showing the state when the power source circuit of each of the above-described embodiments is connected to a liquid crystal panel.

As shown in FIG. 10, a power source circuit 20 having the above-described structure is connected to a liquid crystal display device in which are connected a segment electrode driving control circuit 11 and a common electrode driving control circuit 12 used to drive a liquid crystal panel 10 in which segment electrodes SEn and common electrodes CEn are formed. The liquid crystal panel 10 is a liquid crystal module with 0.33 mm pitch and 640×480 pixels, and time division driving is accomplished by the above-described segment electrode driving control circuit 11 and common electrode driving control circuit 12 under the conditions of 1/240 duty, V−13V bias, and VDD−VEE=28 vmax. The circuit constants at this time are R1=R2=R4=R5=10 kΩ, R3=90 kΩ, R8=R9=R10=R11=4.7Ω, C1=C2=C3=C4=4.7 μF, R12=R13=33 kΩ, and C5=C6=2.2 μF.

Figure 11:
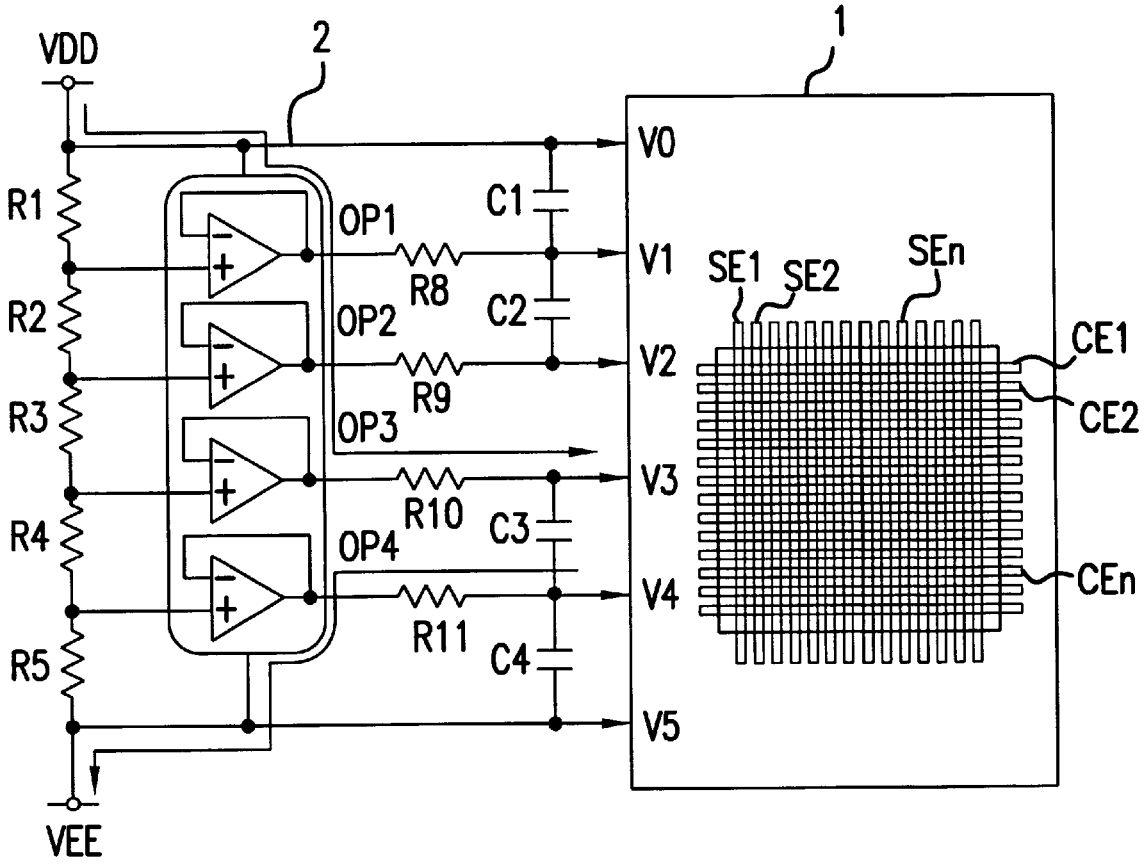
FIG.11 PRIOR ART
FIG. 11 is a schematic circuit diagram showing the composition of one type of conventional liquid crystal display device, and in particular a portion of the power source circuit of such.
Figure 12:
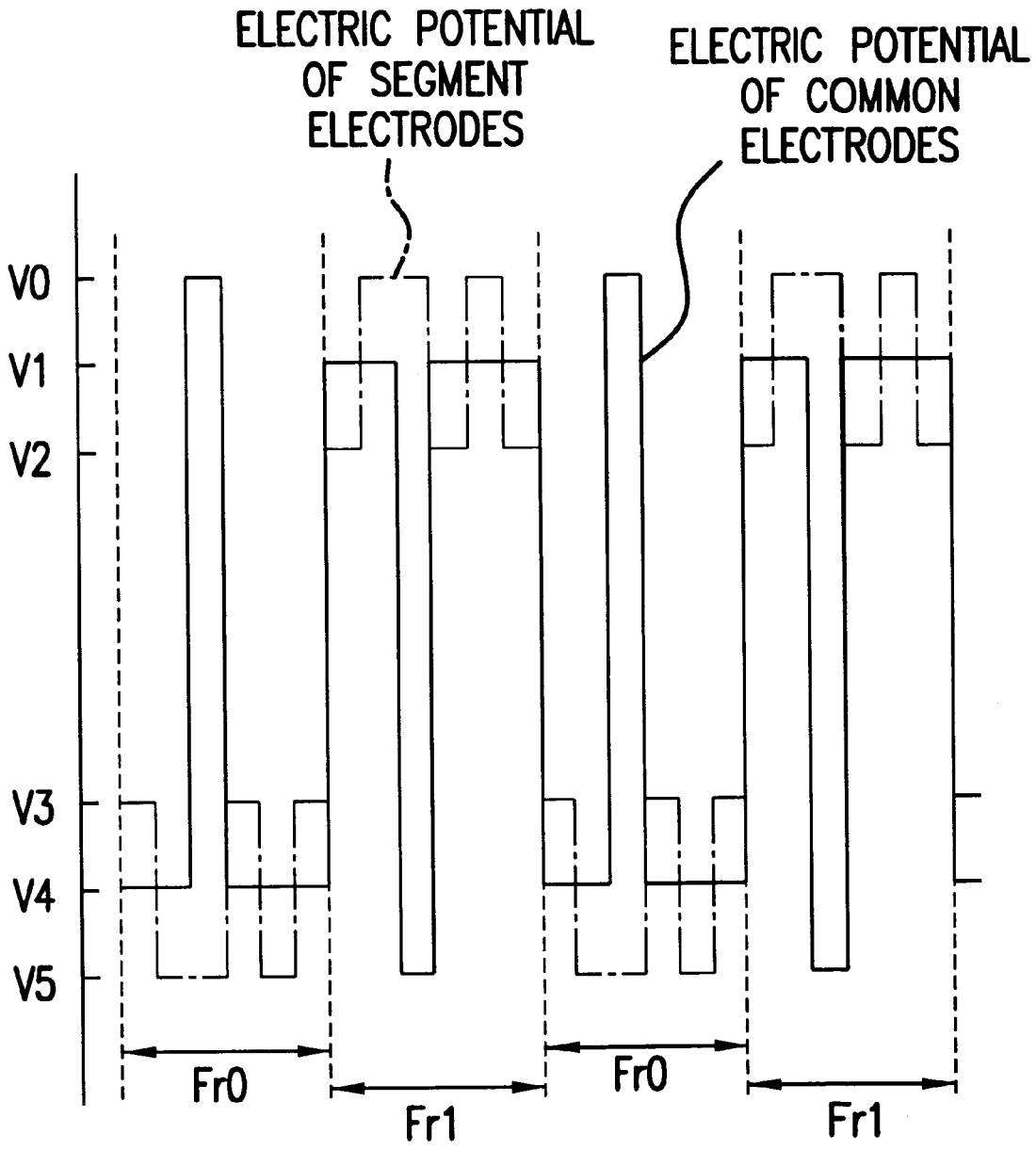
FIG.12 PRIOR ART
FIG. 12 is a graph showing the driving electric potential of a liquid crystal display device.

With the results of experiments performed under the above-described conditions, the electric current consumption of the liquid crystal system was 6.93 mA with the conventional power source circuit shown in FIG. 11, while in contrast to this, the electric current consumption was 4.26 mA with the present embodiment, so that this value was reduced to around 65% of that of the conventional model. In addition, because the power loss of the operational amplifiers themselves was reduced, it became possible to secure derating with inexpensive operational amplifiers with relatively small maximum loss. That is to say, with the conventional structure, the power consumption under the worst conditions was 400 mW, but in the present embodiment, it was possible to reduce this to 270 mW.

In the above-described embodiment, a voltage-dividing circuit S was provided which is equipped, in addition to resistors R12 and R13, with capacitors C5 and C6 in order to obtain stability with respect to the power source voltages VDD and VEE which are supplied from the external power source, in order to form the intermediate electric potential Va, but it is fine to use a circuit structure which does not include capacitors as this voltage dividing circuit S, and in addition, it is also fine to use a circuit structure in which only one of the capacitors C5 and C6 is provided.

Embodiment 2

Next, a second embodiment will be described in which a liquid crystal display device is formed by connecting a power source circuit having the same composition as in the above-described first embodiment to a different liquid crystal panel. In this embodiment, a liquid crystal panel 10 with 0.24 mm pitch and provided with 640×480 pixels is used as the liquid crystal panel 10 shown in FIG. 10, and time division driving is accomplished under the conditions of 1/480 duty, V−22V bias, and VDD−VEE=35 vmax. The circuit constants of the power source circuit this time were R3=180 kΩ, but other than this were all set to the same values as in the above-described first embodiment.

In this embodiment, favorable results were obtained in that the certainty of the operations were secured the same as in the above-described embodiment 1, and it was possible to reduce power consumption. As for the operational amplifiers OP1 through OP4, it was necessary to use operational amplifiers with the characteristic of 40 v voltage resistance in driving the conventional power source circuit under the same conditions as in the present embodiment, but in the present embodiment, it was possible to use general inexpensive operational amplifiers with 30 v voltage resistance.

Embodiment 3

Figure 3:
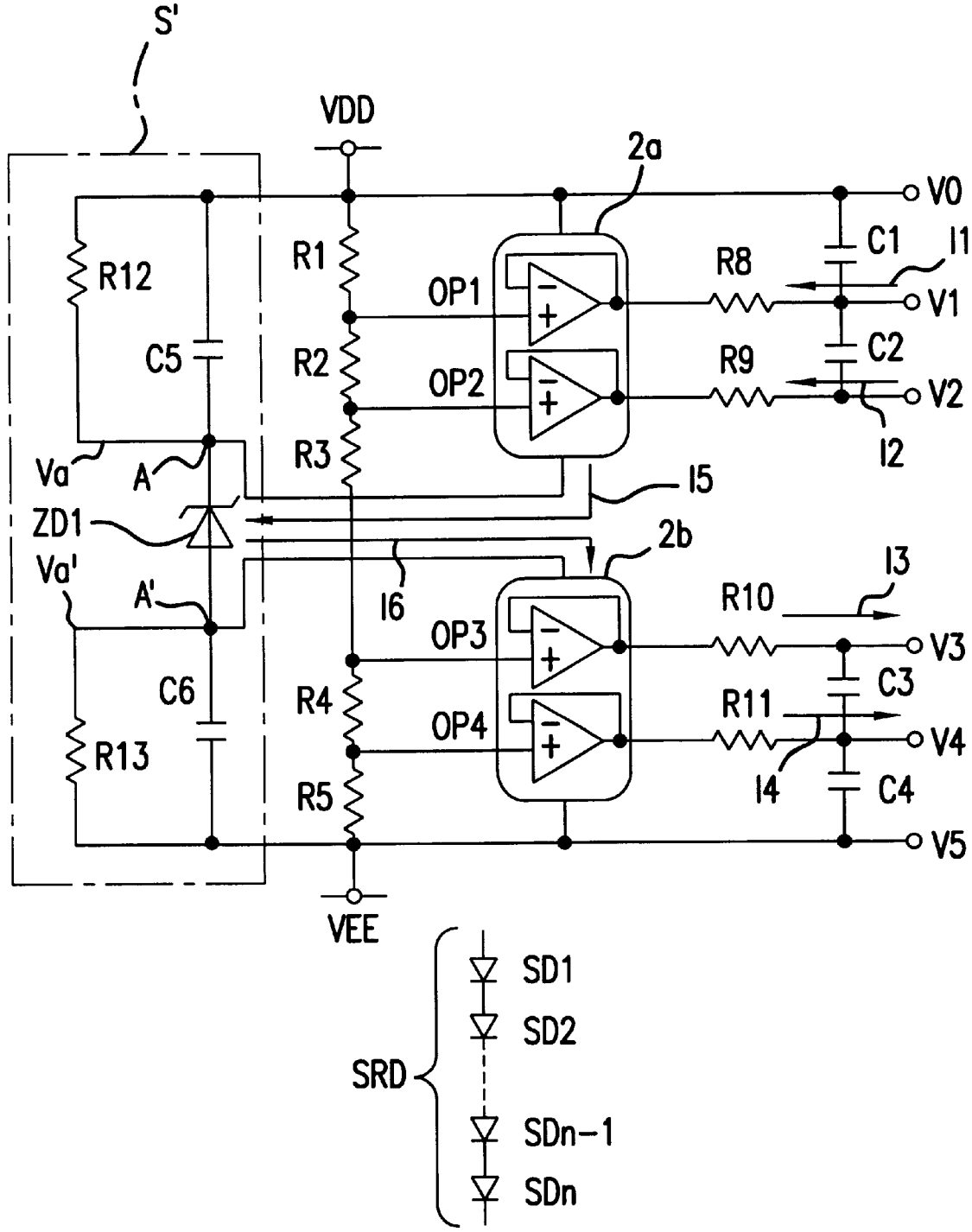
FIG. 3 is a schematic circuit diagram showing the composition of a power source circuit used for driving a liquid crystal display showing the preferred embodiment 3 of the present invention.

FIG. 3 shows the composition of a third embodiment of the power source circuit of the present invention. In this embodiment, everything is the same as in the first and second embodiments with the exception of the internal composition of the voltage dividing circuit S'. The voltage dividing circuit S' in this embodiment has a zener diode ZD1 connected between the intermediate point A and the intermediate point A'. Because of the presence of this zener diode ZD1, a constant electric potential difference corresponding to the zener voltage Vz is created between the intermediate electric potential Va of the intermediate point A and the intermediate electric potential Va' of the intermediate point A', and consequently, the sum of the operation voltage VDD−Va which is supplied to the operational amplifiers OP1 and OP2 and the operation voltage Va'−VEE which is supplied to the operational amplifiers OP3 and OP4 is reduced by a specific electric potential difference Vz from the power source voltage VDD−VEE.

Figure 4:
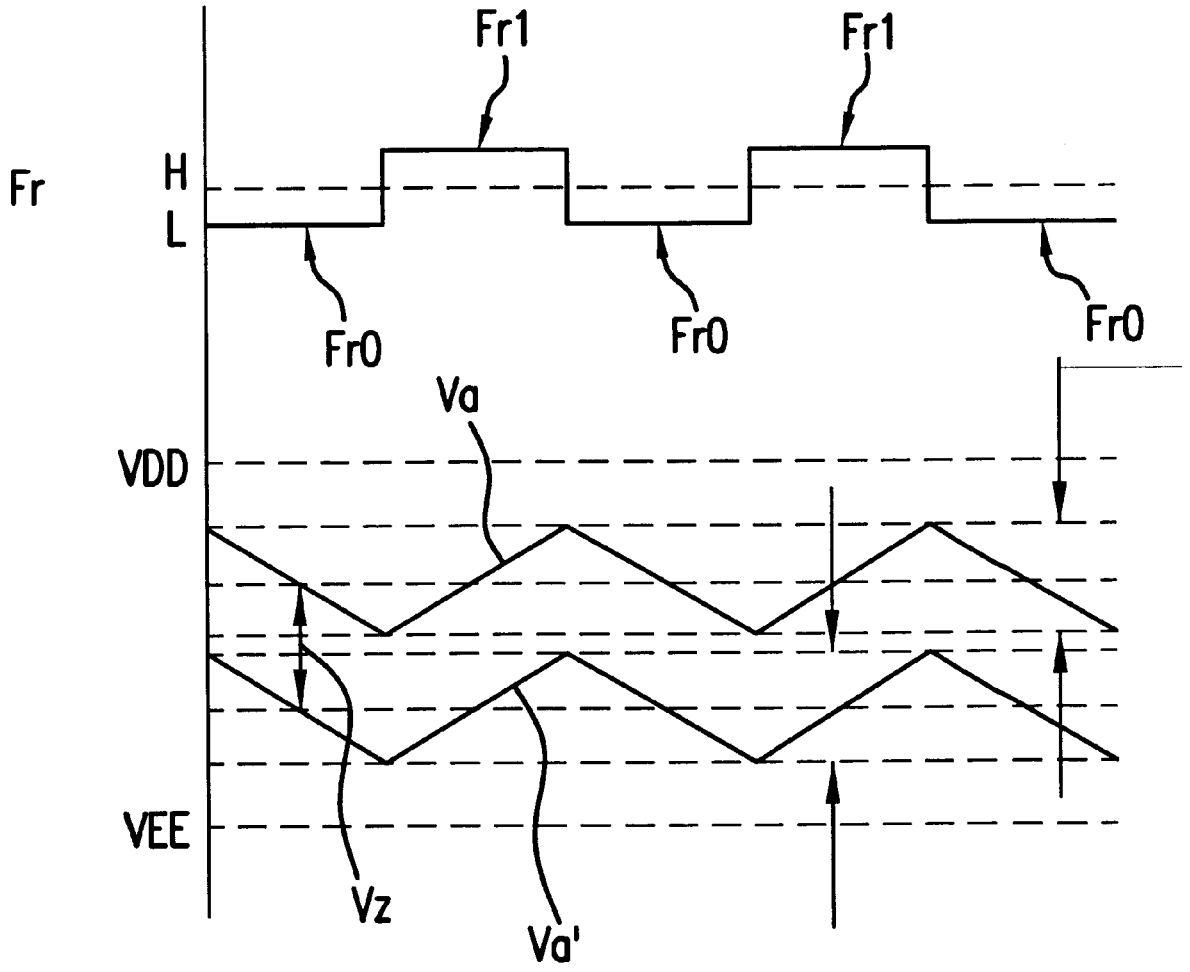
FIG. 4 is a graph showing the relationship between the intermediate electric potentials Va and Va' and the frame interval when embodiment 3 is used in driving a liquid crystal display.

Thus, as shown in FIG. 4, the intermediate electric potentials Va and Va' fluctuate up and down in synchronous with the frame period similar to the intermediate electric potential of the first embodiment. The amplitude of these fluctuations is set in accordance with the rating on the operational amplifiers similar to the above-described first embodiment. The electric potential difference between the intermediate electric potentials Va and Va' is always substantially constant.

In this embodiment, it is possible to reduce further the operation voltage which is impressed on the operational amplifiers OP1 through OP4 more than in the above-described first and second embodiments, and it is also possible to reduce further the limits of the operational amplifiers with respect to the permissible loss and the maximum rating. In this embodiment, the power loss of the power source circuit as a whole is substantially equal to that of the first embodiment.

In the voltage dividing circuit S', it is fine to use, for example, the series circuit SRD in which a plurality of diodes SD1, SD2, . . . , SDn-1, SDn are connected, as shown in the lower portion of FIG. 3, as an insertion circuit inserted between the intermediate points A and A'. The number of connected diodes can be set appropriately in accordance with the required electric potential difference. In this case, the electric potential difference between the intermediate points A and A' is a value that is always substantially constant, being the sum of the forward-direction voltage drop of each diode.

In addition, as the above-described insertion circuit, it is fine to use a circuit which causes a resultant electric potential difference between the intermediate electric potentials Va and Va' such as a simple resistor or capacitor or the like, and this electric potential difference need not be constant if the operation voltage of the operational amplifiers is kept within a permissible range.

Embodiment 4

Figure 5:
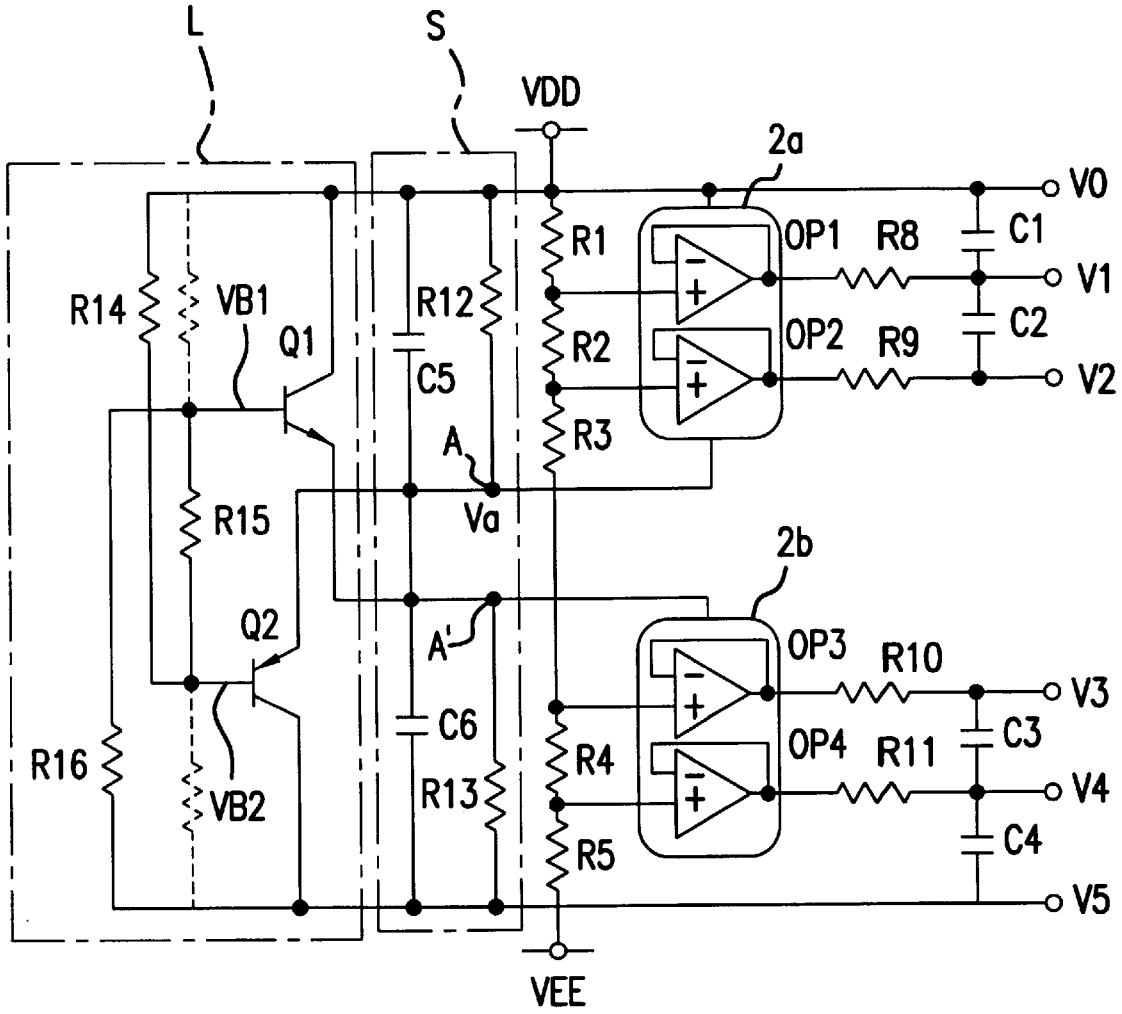
FIG. 5 is a schematic circuit diagram showing the composition of a power source circuit used for driving a liquid crystal display showing the preferred embodiment 4 of the present invention.

Next, the fourth embodiment of the present invention will be described with reference to FIG. 5. In this embodiment, a limiter circuit L is provided in addition to the circuits of the above-described first and second embodiments. This limiter circuit L has the collector terminal and the emitter terminal of a npn-type transistor Q1 connected between the power source electric potential VDD and the intermediate point A', and the collector terminal and emitter terminal of a pnp-type transistor Q2 connected between the intermediate point A and the power source electric potential VEE. It is not necessary to distinguish these when the intermediate points A and A' have the same electric potential Va, as in the present embodiment, but a connection structure similar to that described above can be used to handle cases such as in the above-described third embodiment wherein a electric potential difference is formed between the intermediate points A and A'.

The base terminal of the transistor Q1 is connected to the power source electric potential VEE via a resistor R16, and the base terminal of the transistor Q2 is connected to the power source electric potential VDD via a resistor R14. In addition, a resistor R15 is connected between the base electric potential of the transistor Q1 and the base electric potential of the transistor Q2.

Because a limiter circuit L having this kind of circuit composition is provided, when the intermediate electric potential Va of the intermediate points A and A' tries to drop below the lower limit electric potential Vd which is determined by the properties of the transistors Q1 and Q2 and the resistances of the resistors R14, R15, and R16, the transistor Q1 achieves an on state and current flows from the power source electric potential VDD to the intermediate point A', and consequently, the intermediate electric potential Va is always held not less than the lower limit electric potential Vd. On the other hand, when the intermediate electric potential Va tries to exceed the upper limit electric potential Vu which is similarly set, the transistor Q2 achieves an on state and current is created from the intermediate point A to the power source electric potential VEE, and consequently, the intermediate electric potential Va is always held not greater than the upper limit electric potential Vu.

Figure 6:
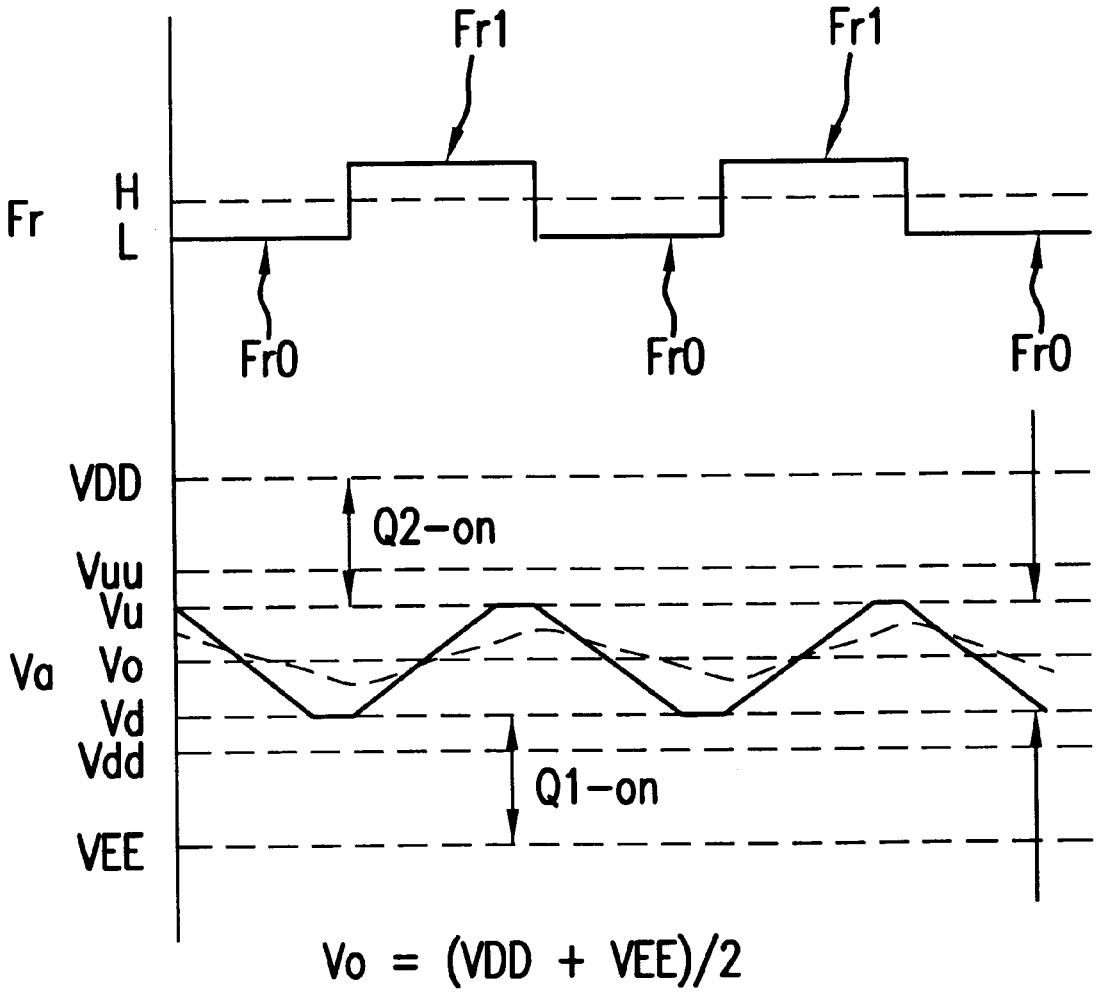
FIG. 6 is a graph showing the relationship between the intermediate electric potentials Va and the frame interval when embodiment 4 is used in driving a liquid crystal display.

FIG. 6 shows the intermediate electric potential Va which is held between the upper limit electric potential Vu and the lower limit electric potential Vd as described above. In the present embodiment, it is possible to limit the fluctuations of the intermediate electric potential Va to within a specific upper limit electric potential Vu and lower limit electric potential Vd by means of the limiter circuit L, and consequently, it is possible to obtain stable output voltages by setting the operation voltage range, which is determined by the upper limit electric potential Vu and the lower limit electric potential Vd, within the permissible operation voltage range of the operational amplifiers OP1 to OP4.

In this case, the fluctuations in the intermediate electric potential Va are forcibly limited to within a prescribed range by the limiter circuit L, and consequently, the benefit is achieved that the circuit constants of the power source circuit can be set without consideration to the fluctuation properties of the intermediate electric potential Va.

In other words, in the above-described first through third embodiments, when the resistances of the resistors R12 and R13 are increased, for example, there is a concern that the fluctuation amplitude of the intermediate electric potential Va will become large and will exceed the permissible operation voltage range of the operational amplifiers, while conversely, when the resistances of the resistors R12 and R13 are made smaller in order to reduce the fluctuation amplitude of the intermediate electric potential Va, the steady current that flows between the power source electric potentials VDD and VEE increases, and the power consumption of the circuit as a whole increases, thereby creating a dilemma. However, in the present embodiment, it is not necessary to worry about the fluctuation amplitude of the intermediate electric potential Va in the state without the limiter circuit L, and consequently, it is possible to set the resistances of the resistors R12 and R13 high, making it possible to reduce the steady current that flows through these resistors and thereby making it possible to further reduce power consumption in the circuit.

In the present embodiment, it is in actuality possible to set the resistances of the resistors R12 and R13, which were 33 kΩ in the above-described first and second embodiments, to 200 kΩ. At this time, when the normal display pattern is caused to be displayed on the liquid crystal panel screen, the electric potential fluctuation amplitude of the intermediate electric potential Va is small, as indicated by the dashed line in FIG. 6, and is kept within the permissible operation voltage range Vuu to Vdd of the operational amplifiers OP1 to OP4. However, when the picture image that is displayed on the liquid crystal panel becomes the worst pattern that consumes more power, the fluctuation amplitude of the intermediate electric potential Va becomes larger and approaches the limits of the permissible operation range of the operational amplifiers or exceeds this range, because the resistances of the resistors R12 and R13 are large. Because the intermediate electric potential Va is limited by the limiter circuit L so that the upper limit electric potential Vu<Vuu and the lower limit electric potential Vd>Vdd, it is possible for the operational amplifiers OP1 to OP4 to continue stable operation without hindrance.

The limiter circuit L is such that the action points of the transistors Q1 and Q2 can be adjusted by the resistors R14, R15 and R16, and calling VBQ1 the base electric potential of the transistor Q1 which is set in this way, and VBQ2 the base electric potential of the transistor Q2, the condition for the transistor Q1 to be in an on state is $$Va \leqq VBQ1-VBE1=Vd \quad (3)$$

and the condition for the transistor Q2 to be in an on state is $$Va \geqq VBQ2+VBE2=Vu \quad (4)$$

VBE1 is the base-emitter voltage of the transistor Q1, and VBE2 is the base-emitter voltage of the transistor Q2, and in a transistor equipped with a normal silicon pn junction, these voltages are on the order of 0.7 v.

In addition, the limiter circuit is not restricted to the above-described configuration, for it is possible to use various commonly known limiter circuits. For example, it is possible for R15 to unnecessarily depend on the properties of the above-descried transistors Q1 and Q2, and in addition, it is also possible to cause a circuit configuration in which the two resistors indicated by the dashed lines inside the limiter circuit L of FIG. 5 are connected in place of the resistors R14 and R16 to function similarly. Or, it is possible to configure the circuit by connecting zener diodes in place of the transistors Q1 and Q2, and to limit the electric potential difference between the power source electric potential VDD and the intermediate electric potential Va, and the electric potential difference between the intermediate electric potential Va and the power source electric potential VEE, to not greater than the respective zener voltages.

Embodiment 5

Figure 7:
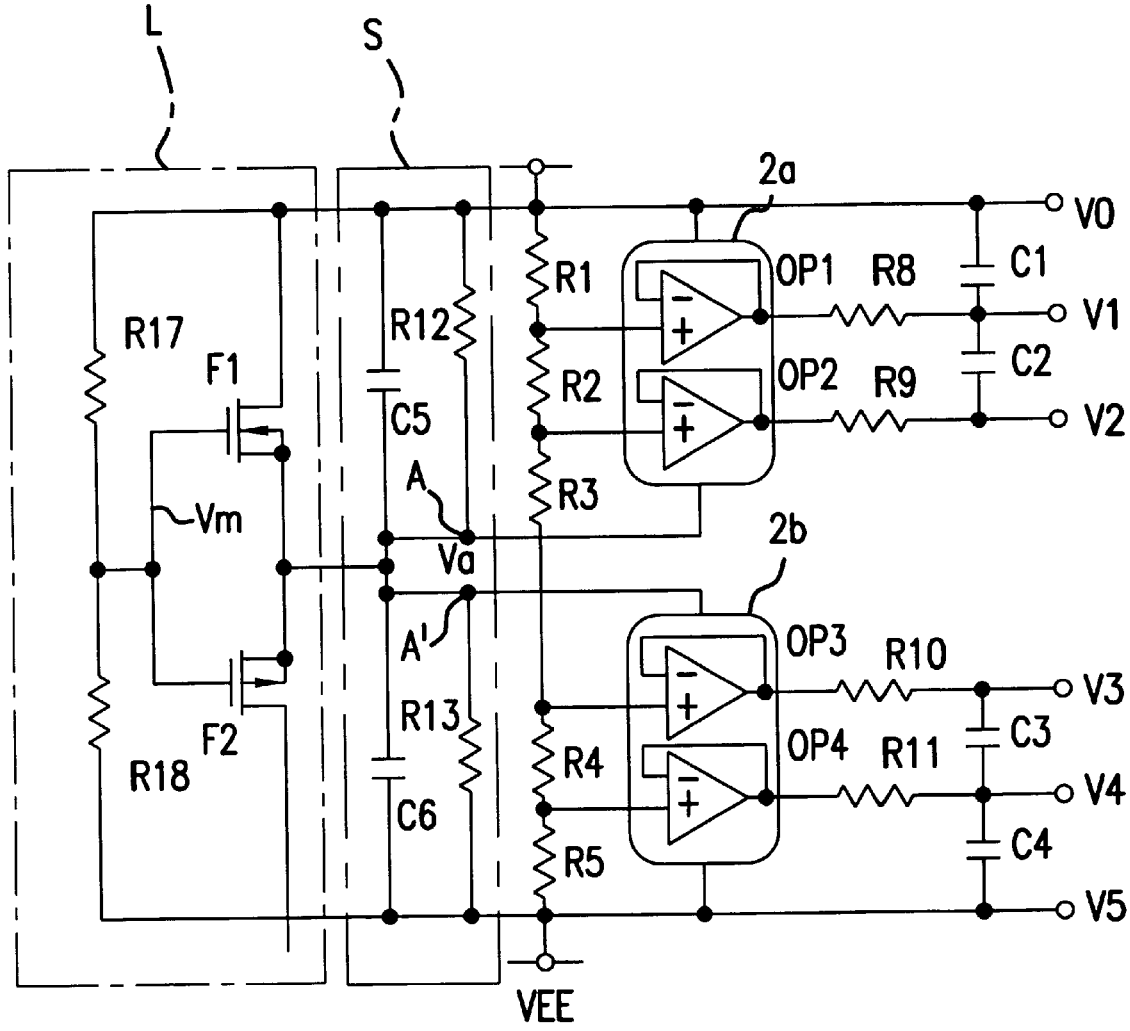
FIG. 7 is a schematic circuit diagram showing the composition of a power source circuit used for driving a liquid crystal display showing the preferred embodiment 5 of the present invention.

Next, a fifth embodiment of the present invention will be described with reference to FIG. 7. In this embodiment, only the configuration of the limiter circuit L' differs from the above-described fourth embodiment. In this limiter circuit L', a field effect transistor (FET) F1 is connected between the power source electric potential VDD and the intermediate electric potential Va, and a field effect transistor F2 is connected between the intermediate electric potential Va and the power source electric potential VEE. In addition, the gate electric potential Vm of these field effect transistors F1 and F2 are set by a voltage dividing circuit comprised of large resistors R17 and R18.

Figure 8:
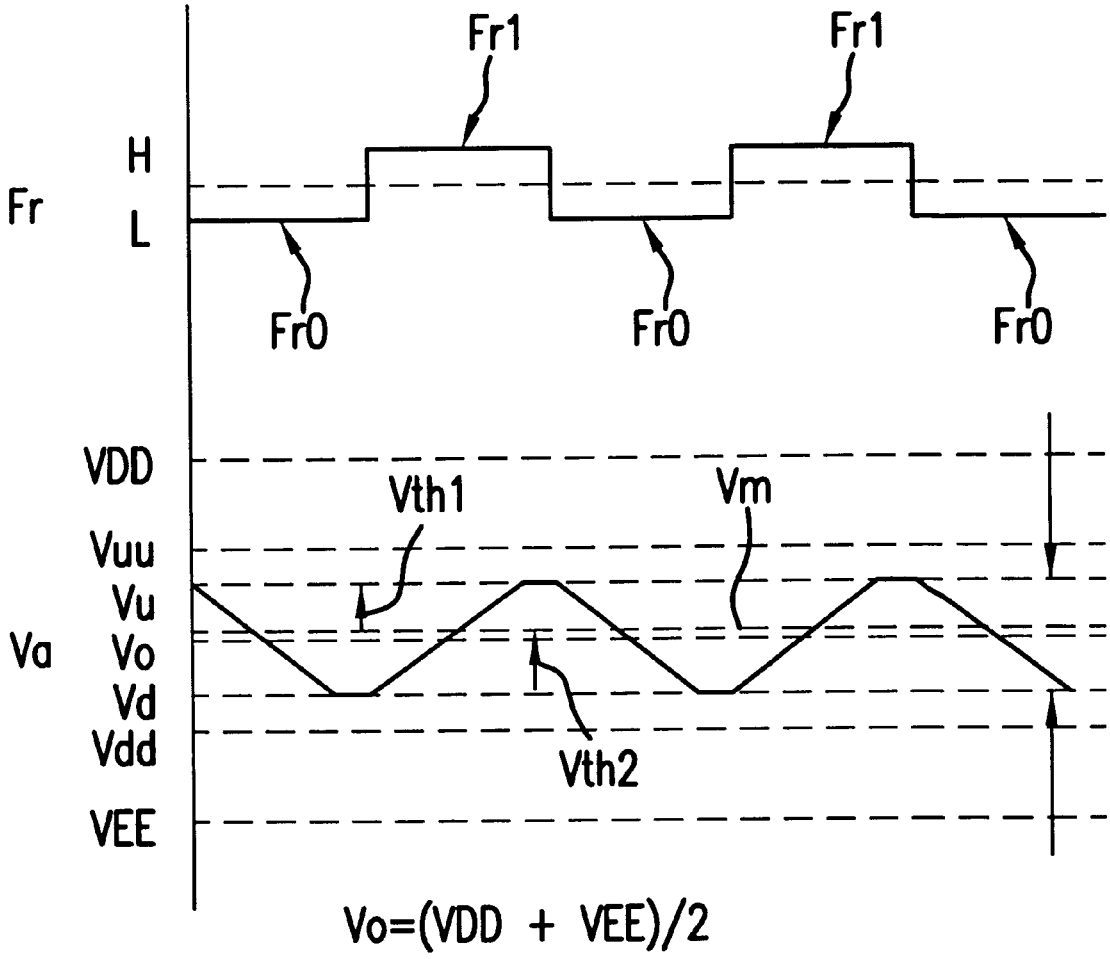
FIG. 8 is a graph showing the relationship between the intermediate electric potentials Va and the frame interval when embodiment 5 is used in driving a liquid crystal display.

In this embodiment, the up and down fluctuations of the intermediate electric potential Va are limited as shown in FIG. 8, similar to the above-described fourth embodiment. That is to say, when the intermediate electric potential Va drops and $$Va \leqq Vm-Vth1=Vd \quad (5)$$

the field effect transistor F1 achieves an on state, current flows from the power source electric potential VDD to the intermediate electric potential Va, and the electric potential drop of the intermediate electric potential Va is limited.

In addition, when the intermediate electric potential Va rises and $$Va \geqq Vm+Vth2=Vu \quad (6)$$

the field effect transistor F2 achieves an on state, current flows from the intermediate electric potential Va to the power source electric potential VEE, and the electric potential rise in the intermediate electric potential Va is limited.

Embodiment 6

Figure 9:
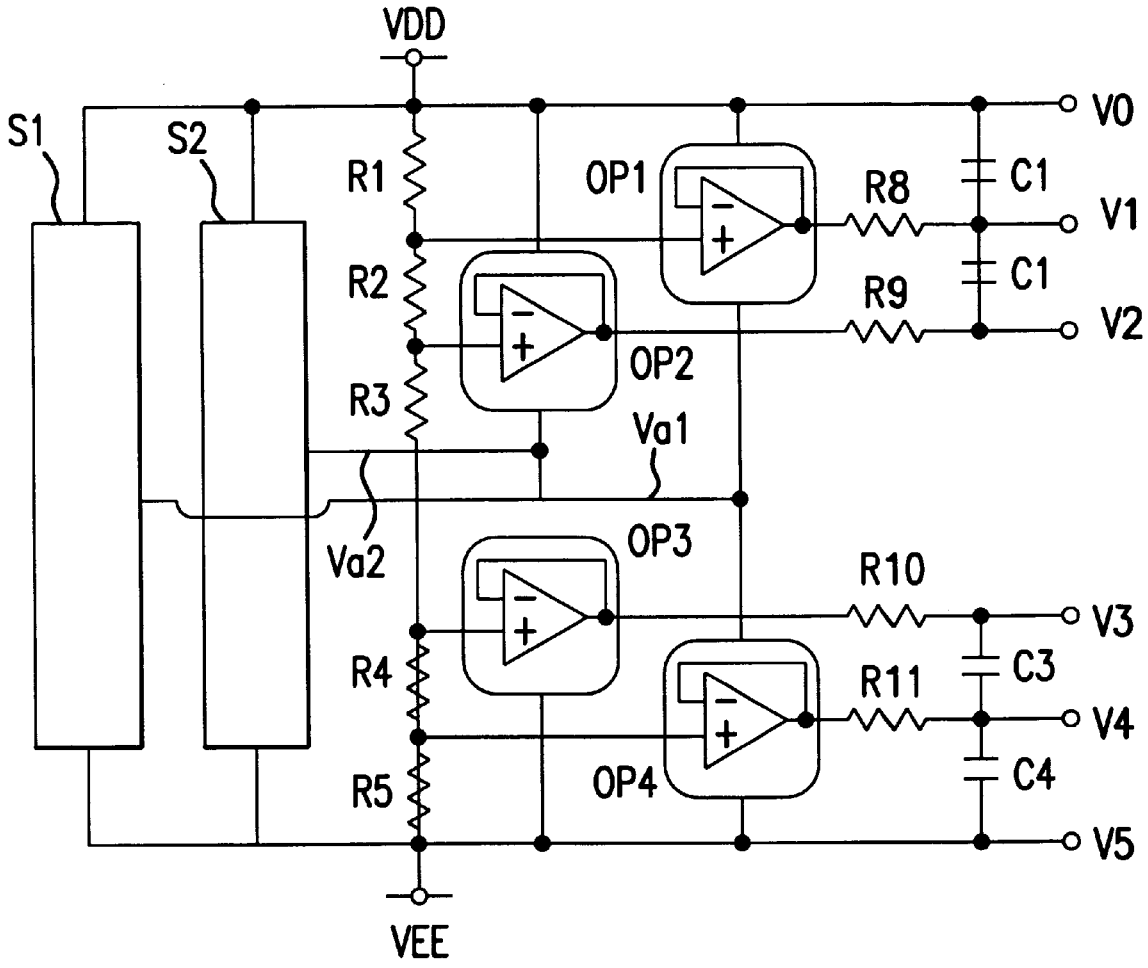
FIG. 9 is a schematic circuit diagram showing the composition of a power source circuit used for driving a liquid crystal display showing the preferred embodiment 6 of the present invention.

Finally, a sixth embodiment of the present invention will be described with reference to FIG. 9. In this embodiment, two voltage dividing circuits S1 and S2 are provided, and the intermediate electric potential Va1 which is output from the voltage dividing circuit S1 is supplied to the operational amplifiers OP1 and OP4, out of the four operational amplifiers OP1 to OP4, and the intermediate electric potential Va2 which is output from the voltage dividing circuit S2 is supplied to the operational amplifiers OP2 and OP3.

In this kind of circuit configuration, it is basically possible to achieve, as in the above-described embodiments, a reduction in power consumption and an easing of the rating requirement level of the operational amplifiers. In addition, in this embodiment, each of the charging currents or discharging currents which passes through one of the operational amplifiers provided for each output electric potential temporarily becomes the current into or out of the intermediate electric potential.

As shown in this embodiment, in the present invention the intermediate electric potential which is utilized as the operation electric potential of the operational amplifiers may be a plurality of electric potentials, and in addition, a plurality of voltage dividing circuits may also be provided. Furthermore, it is also possible to form a plurality of mutually differing intermediate electric potentials, and to cause the operational amplifiers to act through the electric potential differences between these intermediate electric potentials.

In addition, the circuit configuration which is used to form the intermediate electric potentials of the present invention is not limited to the above-described voltage dividing circuits which use resistors, for various other commonly known electric potential conversion circuits which use capacitors or inductors may be used as long as it is possible to obtain the electric potentials between the power source electric potentials VDD and VEE as a result.

Furthermore, the configuration of the output circuit of the present invention is not limited to a voltage follower which is comprised of operational amplifiers, for it is also possible to use output circuits having various circuit configurations. For example, it is possible to use a circuit which includes a circuit that produces an output electric potential by forming, from the power source electric potential and a plurality of electric potentials that are formed directly or indirectly on the basis of this power source electric potential, electric potentials which differ from this.

INDUSTRIAL APPLICATIONS

As described above, with the power source circuit, liquid crystal display driving power source and liquid crystal display device of the present invention, it is possible to reduce the driving voltage which is supplied to the output circuit regardless of the power source voltage, and consequently, it is possible to achieve an inexpensive configuration because the voltage resistance of the output circuit can be set low, in addition to reducing production costs and reducing the power consumption of the output circuit.

What is claimed is:

1. A power source circuit, comprising:

a plurality of output circuit units which supply a plurality of output electric potentials based on a plurality of input electric potentials; and an intermediate electric potential forming unit which forms at least one intermediate electric potential between a first electric potential and a second electric potential, the first electric potential being different from the second electric potential, a first supply potential and a second supply potential supplying power to the plurality of output circuit units, the first supply potential for each of the output circuit units being one of the first electric potential and the second electric potential, and the second supply potential being the at least one intermediate electric potential, the first and second supply potential being different from each other; and a capacitor connected between the at least one intermediate electric potential and at least one of the first and second electric potentials.

2. The power source circuit of claim 1, the first electric potential and the at least one intermediate electric potential being supplied as the driving electric potentials to a first portion of the plurality of output circuit units and the at least one intermediate electric potential and the second electric potential being supplied as the driving electric potentials to a second portion of the plurality of output circuit units.

3. The power source circuit of claim 1, the intermediate electric potential forming unit comprising:

electric potential maintaining means for suppressing fluctuations in the at least one intermediate electric potential.

4. The power source circuit of claim 3, the electric potential maintaining means comprising:

a first capacitor connected between the first electric potential and the at least one intermediate electric potential and a second capacitor connected between the second electric potential and the at least intermediate electric potential.

5. The power source circuit of claim 1, the intermediate electric potential forming unit comprising:

a voltage divider circuit which forms the at least one intermediate electric potential based on the first and the second electric potentials.

6. The power source circuit of claim 5, the voltage divider circuit comprising resistors.

7. The power source circuit of claim 5, the voltage divider circuit comprising a zener diode.

8. The power source circuit of claim 5, the voltage divider circuit comprising at least one diode.

9. The power source circuit of claim 1, further comprising:

electric potential fluctuation limiting means for limiting electric potential fluctuations of the at least one intermediate electric potential to a preset range.

10. The power source circuit of claim 9, the electric potential fluctuation limiting means comprising:

a limiter circuit that sets an upper limit electric potential and a lower limit electric potential of the at least one intermediate electric potential.

11. The power source circuit of claim 10, the limiter circuit comprising:

a first semiconductor device which sets the upper limit electric potential of the at least one intermediate electric potential, and a second semiconductor device which sets the lower limit electric potential of the at least one intermediate electric potential.

12. The power source circuit of claim 11, the plurality of output circuit units comprising:

operational amplifiers forming voltage followers, electric potentials formed by voltage dividers based on the first and the second electric potentials being input to the operational amplifiers.

13. The power source circuit of claim 1, the plurality of output circuit units being powered by the same intermediate electric potential, and a first capacitor connected between the first electric potential and the same intermediate electric potential, and a second capacitor connected between the second electric potential and the same intermediate electric potential.

14. The power source circuit of claim 1, the at least one intermediate electric potential comprising first and second intermediate electric potentials, one of the plurality of output circuit units being powered by the first intermediate electric potential and another one of the plurality of output circuit units being powered by the second intermediate electric potential, and the capacitor comprising a first capacitor connected between the first electric potential and the first intermediate electric potential, and a second capacitor connected between the second electric potential and the second intermediate electric potential.

15. A method for supplying a plurality of output electric potentials, comprising:

forming at least one intermediate electric potential between a first electric potential and a second electric potential, the at least one intermediate electric potential being formed by an intermediate electric potential forming unit;

powering a plurality of output circuit units with a first supply potential and a second supply potential, the first supply potential for each of the output circuit units being either the first electric potential or the second electric potential, the second supply potential being the at least one intermediate electric potential, the first and the second supply potentials being different from each other, and a capacitor being connected between the at least one intermediate electric potential and at least one of the first and second electric potentials; and supplying the plurality of output electric potentials through the plurality of output circuit units.

16. The method of claim 15, the driving step comprising:

driving a first portion of the plurality of output ciurcuit units with the first electric potential and the at least one intermediate electric potential potentials; and driving a second portion of the plurality of output circuit units with the at least one intermediate electric potential and the second electric potential.

17. The method of claim 15, the forming step comprising:

suppressing fluctuations in the at least one intermediate electric potential with electric potential maintaining means, the electric potential maintaining means including a capacitor connected between the at least one intermediate electrical potential and one of the first and second electric potentials.

18. The method of claim 15, the forming step comprising:

forming the at least one intermediate electric potential with a voltage divider circuit based on the first and second electric potentials.

19. The method of claim 15, further comprising:

limiting electric potential fluctuations of the at least one intermediate electric potential to a preset range with electric potential fluctuation limiting means.

20. A liquid crystal display device that includes a power source circuit, the power source circuit comprising:

a plurality of output circuit units which supply a plurallity of output electric potentials based on a plurality of input electric potentials; and an intermediate electric potential forming unit which forms at least one intermediate electric potential between a first electric potential and a second electric potential, the first electric potential being different from the second electric potential, a first supply potential and a second supply potential supplying power to the plurality of output circuit units, the first supply potential for each of the output circuit units being one of the first electric potential and the second electric potential, and the second supply potential being the at least one intermediate electric potential, the first and the second supply potentials being different from each other; and a capacitor connected between one of the at least one intermediate electric potential and at least one of the first and second electric potentials.

21. A power source circuit, comprising:

a plurality of output circuit units which supply a plurality of output electric potentials based on a plurality of input electric potentials;

an intermediate electric potential forming unit which forms at least one intermediate electric potential between a first electric potential and a second electric potential, the first electric potential being different from the second electric potential, a first supply potential and a second supply potential supplying power to the plurality of output circuit units, the first and second supply potential being different from each other, the second supply potential for each of the output circuit units being the at least one intermediate electric potential and the first supply potential for each of the output circuit units being either the first electric potential or the second electric potential; and a limiting circuit setting an upper limit electric potential and a lower limit electric potential of the at least one intermediate electric potential.

22. A liquid crystal display device comprising the power source circuit of claim 21.

23. A power source circuit, comprising:

a plurality of output circuit units which supply a plurality of output electric potentials based on a plurality of input electric potentials;

an intermediate electric potential forming unit which forms a plurality of intermediate electric potential between a first electric potential and a second electric potential, the first electric potential being different from the second electric potential, a first supply potential and a second supply potential supplying power to the plurality of output circuit units, the first and second supply potential being different from each other, the second supply potential for a first one of the output circuit units being a first one of the plurality of intermediate electric potentials and the second supply potential for a second one of the output circuit units being a second one of the plurality of intermediate electric potentials, and the first supply potential for each of the output circuit units being one of the first electric potential and the second electric potential; and a diode connected between the first one of the intermediate electric potentials and the second one of the intermediate electric potentials.

24. The power source circuit of claim 23, the diode being a zener diode.

25. The power source circuit of claim 24, the diode being at least one forward direction diode.

26. A liquid crystal display device comprising the power source circuit of claim 23.

* * * * *